United States Patent [19]

Hume

[11] 4,371,353

[45] Feb. 1, 1983

[54] LIFE JACKETS

[76] Inventor: Peter J. Hume, 19-23 Tennyson St., Wellington, New Zealand

[21] Appl. No.: 256,508

[22] Filed: Apr. 22, 1981

Related U.S. Application Data

[63] Continuation of Ser. No. 25,106, Mar. 29, 1979, abandoned.

[30] Foreign Application Priority Data

Mar. 31, 1978 [NZ] New Zealand ..... 186849

[51] Int. Cl.[3] ..... A63C 9/08

[52] U.S. Cl. ..... 441/117

[58] Field of Search ..... 9/311, 333, 336, 337, 9/338, 340, 341, 342, 345; 83/32; 441/88, 106, 107, 108, 111, 112, 113, 114, 115, 116, 117, 118, 119

[56] References Cited

U.S. PATENT DOCUMENTS

| | | | |
|---|---|---|---|
| 3,193,856 | 7/1965 | Coolidge | 9/337 |
| 3,266,070 | 8/1966 | O'Link | 9/342 |
| 3,383,722 | 5/1968 | LeBlanc | 9/338 |
| 3,398,614 | 8/1968 | Cleary | 83/32 |
| 3,761,982 | 10/1973 | Hawkins | 9/342 |

FOREIGN PATENT DOCUMENTS

| | | | |
|---|---|---|---|
| 656610 | 1/1963 | Canada | 9/338 |
| 113921 | 4/1945 | Sweden | 9/338 |
| 193270 | 12/1964 | Sweden | 9/345 |

*Primary Examiner*—Charles E. Frankfort
*Assistant Examiner*—Jesús D. Sotelo
*Attorney, Agent, or Firm*—Holman & Stern

[57] ABSTRACT

A life jacket manufactured using a continuous length of flexible buoyant material which is encased in a fabric so as to provide buoyant front regions and a buoyant neck region, the length of buoyant material passing from the front of a wearer about the wearer's neck and back down the front of the wearer. The continuous length includes a specially cut region for the neck vicinity to enhance comfort.

6 Claims, 5 Drawing Figures

LIFE JACKETS

This is a continuation of application Ser. No. 025,106, filed Mar. 29, 1979 (now abandoned).

BRIEF SUMMARY OF THE INVENTION

The present invention relates to improvements in or relating to life jackets and methods of manufacture thereof.

Many forms of life jacket are known. More recently modern ones use a synthetic foam material as the buoyancy material. Such a foam material is of a closed cell type and is preferably flexible so that the same does not tend to fragment within its containing cover during use or stowage. There is however still a great deal of improvement that can be made on techniques for preparing the buoyancy material for inclusion in the normally reflective covering member which also carries the straps etc.

It is therefore an object of the present invention to provide a life jacket and means of manufacture thereof which will go at least some way to meet the abovementioned desiderata or which will at least provide the public with a useful choice.

Accordingly, in one aspect the present invention consists in a life jacket as hereinbefore defined which includes as a buoyancy element thereof a continuous length of substantially flexible buoyant material which extends in use from the front of a wearer, round the wearer's neck and down the front of the wearer again, each end of said length of buoyant material being substantially at the same height down the front of such a wearer.

Preferably, the material is formed substantially in a strip form, but includes for the neck regions a curved portion. Preferably the curved portion is formed by using a common radius or curve for each side of the curved region of the length so that when being manufactured, the most economical use of the buoyant material occurs.

Preferably the strip of material is substantially as hereinafter described.

Preferably the frontal buoyant sections of the length have an enhanced bulk or include associated therewith extra buoyancy portions.

Preferably the frontal portions of the length of buoyant material are separately contained in an envelope. Preferably the containment is substantially as hereinafter described.

Preferably a strap is provided to hold the frontal portions of the contained buoyant material to a wearer's body.

Preferably a neck tie arrangement is provided at the neck region of the life jacket.

The present invention may be made by a method of manufacturing which involves obtaining a length of buoyant material and encasing the same in a containment member formed from a flexible sheet material, including ties and the like as necessary.

As used hereinthroughout the term "life jacket" includes a buoyancy aid capable of being worn substantially as a jacket or the like notwithstanding the back of a wearer may not be covered.

BRIEF DESCRIPTION OF THE SEVERAL VIEWS OF THE DRAWING

One preferred form of the present invention will now be described with reference to the accompanying drawings in which.

DETAILED DESCRIPTION

Figure 2:
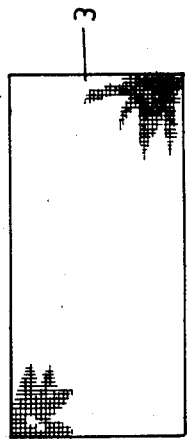
FIG. 2 shows one of two rectangles of buoyant material which enhance the buoyancy of the frontal region of a completed life jacket, FIG. 3 provides a view from the back of a life jacket in accordance with the present invention showing the adjustable strap thereof and the two pocket or separate panel arrangement of the frontal region thereof.
Figure 1:
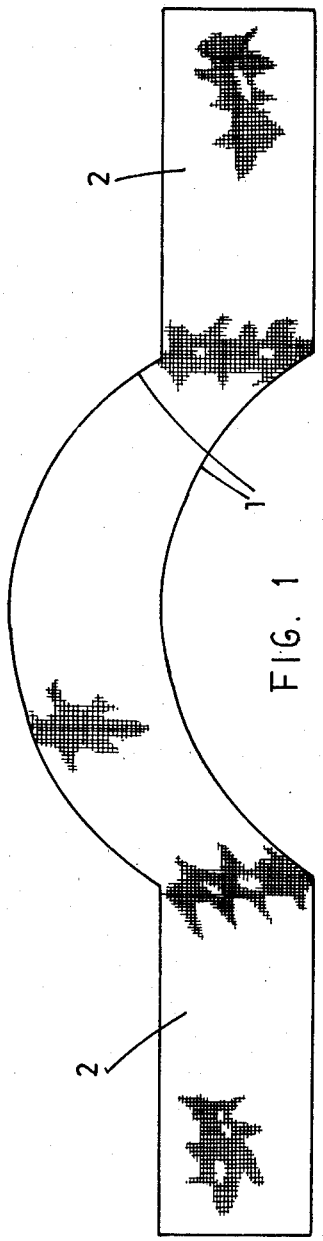
FIG. 1 is a plan view of a length of buoyant material in accordance with the present invention.

In the preferred form of the present invention, the length of buoyant material is cut in the form as shown in FIG. 1. The actual length of the material is not critical, but it could, for example, be 48" and have a curved central region of 18". Ideally, the curve is formed by using common radii 1 so that the same makes the most economical use of the buoyant material when the same is being cut or clipped from a blank. Ideally the foam material is of the closed cell type which is flexible. Ideally the thickness is approximately 1" and ideally it is 6" wide at the frontal portions 2 and at the maximum width of the curved portion. To enhance the buoyancy effect of the frontal portions 2, a rectangle of the same material is overlaid. Obviously however, it would be possible in some forms to provide a contoured buoyant material which could be cut substantially in the same way as shown in FIG. 1 so that the frontal portions 2 have an increased buoyancy over the curved neck region without it being necessary to use an additional overlying feature. However, these are refinements for the future. It is important to realize however, that for comfort, ideally there should be less bulk to the neck region in the completed jacket than in the frontal portions 2. Such a requirement also stems from the need for a life jacket to turn a wearer onto his back with the head above the water, so that the same meets standards that are normally based on an unconscious wearer.

Figure 5:
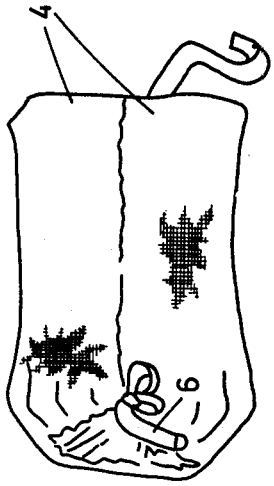
FIG. 5 is a frontal view of the life jacket of FIGS. 3 and 4 showing the neck tie thereof.
Figure 4:
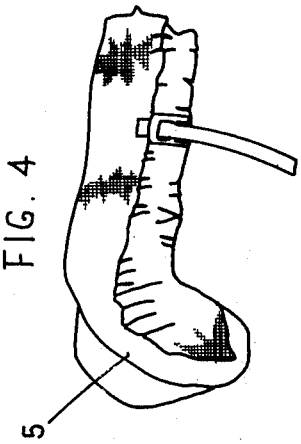
FIG. 4 is a side view of the life jacket of FIG. 3.
Figure 3:
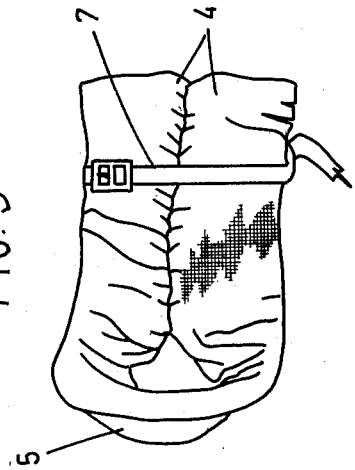

Turning to FIGS. 3 to 5 therefore, it can be seen that there are frontal portions 4 contained as separate panels or pockets in the containing material, for example a synthetic fabric. The neck region 5 it can be seen is selfsupporting inasfar as shape is concerned. The same however is pliable bearing in mind the nature of the buoyant material. The actual cover for the neck region includes a neck tie arrangement 6 so that the same fits snugly on any wearer. A person skilled in the art will appreciate how this can be effected. Similarly with the back strap 7, which is to hold the frontal panels or buoyant pockets or whatever onto a wearer in an operative condition.

The covering material holds the buoyant front pieces substantially side by side. This is preferably achieved by having the covering material of the front portions at its inner regions oversewn. Other ways other than the use of an integral cover would be to use for example a slide fastener. Ideally the frontal portions are joined for only the bottom few inches so that there is a sufficient opening above for the lifejacket to be pulled over the head.

When the jacket is worn this covering material extends across and covers the wearer's back.

From the foregoing it can be seen that the present invention provides a minimum of fabrication, bearing in mind the fact that it is not necessary to individually pocket a variety of different buoyant masses and the use of a continuous length offers significant advantages inasfar as costs over any existing technique.

What is claimed is:

1. A non-inflatable life jacket comprising a continuous length of buoyant material which is substantially conformable to the shape of the wearer which when unconformed includes substantially centrally of the longitudinal length thereof an integral offset arced region configured to allow the same to deform and be conformed to encompass the nape and sides of the wearer's neck with the end regions of said buoyant material extending alongside each other down at least the wearer's chest to form front portions, said arced region being formed by an inner concave curve and an outer convex curve, said curves being substantially semicircular and having substantially the same radius, said end regions being substantially rectangular in shape and substantially aligned in the unconformed position, said inner concave curve being substantially tangential to the plane including the edges of said end regions at which said outer convex curve terminates, means to retain said buoyant material substantially in the conformed condition for wearing, and means to hold said buoyant material to the wearer so as in use to support his weight comprising means encircling the wearer's back which holds said end regions to his front.

2. A life jacket as claimed in claim 1 wherein each end of said continuous length of buoyant material terminates at a position substantially at the waist of a wearer.

3. A life jacket as claimed in claim 2 wherein said buoyant material is thicker at said end regions than at said arced region.

4. A life jacket as claimed in claim 2 wherein said buoyant material is encased in a flexible sheet material and said flexible sheet material extends across and fully covers the wearer's back in use.

5. A life jacket as claimed in claim 4 wherein said means to retain said buoyant material substantially conformed comprises said flexible sheet material being joined at the front by a spanning between the two front portions which holds the two front portions substantially side by side over the wearer's chest.

6. A life jacket as claimed in claim 5 wherein said means to hold said buoyant material to the wearer comprises at least one strap means attached to said buoyant material and adapted to be encircled around a wearer's waist and tied over the front regions of the jacket.

* * * * *